United States Patent [19]

Calder et al.

[11] 4,147,172

[45] Apr. 3, 1979

[54] SMOKING MIXTURES

[75] Inventors: Alan Calder; Alan J. Herd, both of Blackley, England

[73] Assignee: Imperial Chemical Industries Limited, London, England

[21] Appl. No.: 806,377

[22] Filed: Jun. 14, 1977

Related U.S. Application Data

[63] Continuation of Ser. No. 594,086, Jul. 8, 1975, abandoned.

[30] Foreign Application Priority Data

Jul. 16, 1974 [GB] United Kingdom ..... 31426/74

[51] Int. Cl.[2] ..... A24D 1/18

[52] U.S. Cl. ..... 131/2

[58] Field of Search ..... 131/2, 17, 140 R, 140 C, 131/15 R, 15

[56] References Cited

U.S. PATENT DOCUMENTS

| | | | |
|---|---|---|---|
| T912,011 | 7/1973 | Harpham et al. | 131/2 |
| 1,972,718 | 9/1934 | Sharlit | 131/17 X |
| 2,007,407 | 7/1935 | Sadtler | 131/17 R |
| 3,545,448 | 12/1970 | Mormon | 131/2 |
| 3,608,566 | 9/1971 | Briskin et al. | 131/2 |
| 3,931,824 | 1/1976 | Miano et al. | 131/2 |

FOREIGN PATENT DOCUMENTS

| | | | |
|---|---|---|---|
| 1299296 | 12/1972 | United Kingdom | 131/2 |

OTHER PUBLICATIONS

*Tobacco & Tobacco Smoke* by Wynder et al., 1967, Academic Press, N.Y. & London, p. 350.

*The Chemistry & Technology of Tobacco,* vol. III, pub. by Pishchepromizdat, Moscow, 1953, pp. 602 & 603.

*Dangerous Prop. of Industrial Materials* by Sax, 3rd edition, p. 461, cited Reinhold Book Corp., 1969.

*Primary Examiner*—Robert W. Michell

*Assistant Examiner*—V. Millin

*Attorney, Agent, or Firm*—Cushman, Darby & Cushman

[57] ABSTRACT

A smoking material in film form comprising a film-forming binder, inorganic filler and a smectite, particularly a bentonite, which smectite is finely dispersed throughout the material. Fine dispersion is achieved by high energy input during mixing with water, and results in improved ash coherence and greater combustion retardance by the smectite. The materials are characterized by relatively low air porosity.

12 Claims, No Drawings

SMOKING MIXTURES

This is a continuation, of application Ser. No. 594,086 filed July 8, 1975 now abandoned.

This invention relates to smoking mixtures and more particularly to smoking mixtures containing natural or synthetic swelling clays.

Hereinafter we use the term "smectite" to indicate a natural or synthetic swelling clay. This usage of the term includes montmorillonite, beidellite, nontronite, saponite, hectorite and sauconite. Montmorillonite is the principle constituent of bentonite clays which have exceptionally high water absorbing and cation exchange properties.

Natural bentonite is a clay mineral consisting essentially of montmorillonite, a complex aluminium silicate. This is naturally associated with cations, chiefly calcium ions but also some sodium ions. Treatment of natural bentonite may alter the relative proportions of the associated cations or introduce new cations, but the treated products, together with those occuring naturally, are collectively known as bentonites. We may for example refer to calcium bentonites, meaning bentonites in which the associated cations are predominantly but not exclusively calcium, and sodium bentonites, meaning bentonites in which such ions are predominantly but not exclusively sodium.

Smectites in solid form are aggregates of very small particles. In particular, X-ray investigations have revealed that the elementary unit layer of montmorillonite consists of three sheets: an octahedral sheet of hydrargillite-brucite included between two tetrahedral sheets of silicon and oxygen. Exchangeable cations occur between silica layers. Accordingly the properties of bentonites and similarly the properties of all smectites are very much influenced by the nature of the associated exchangeable cations.

It is known to incorporate smectites, particularly bentonites in fabricated smoking materials - for example smoking materials in the form of films or other forms from which tobacco simulating material can be obtained, but hitherto the incorporation has been carried out by slurrying solid smectite and all the other ingredients together with water at ambient temperatures and fabricating the slurry, for example into a film. By these known techniques the smectite in fabricated smoking materials has not been very finely dispersed, even though some smectites do disperse in water more easily, relative to others, for example sodium bentonites disperse more easily than calcium bentonites.

The degree of disaggregation brought about by agitating a smectite with water increases with the energy input. Under standard conditions of rapid agitation a point is reached where the viscosity reaches a maximum value. Hereinafter the expression "finely dispersed smectite" refers to a smectite of such fine dispersion as is produced by agitating it in water at 15° C. with an input of 0.04 and preferably 0.08 joules/g/sec until a maximum viscosity is reached.

The invention provides a fabricated smoking material comprising a film-forming binder, inorganic filler and a smectite, which smectite is finely dispersed throughout the smoking material.

Essential ingredients in the smoking materials of the invention are the film forming binder, inorganic filler and smectite but other ingredients may also be incorporated, especially particulate combustible matter. Further possible ingredients are, for example, humectants e.g. glycerol, glycols; glow controlling catalysts e.g. potassium citrate; colouring matters; flavourants, and nicotine.

As film-forming binders there may be used cellulose ethers, for example methyl cellulose and especially carboxymethyl cellulose and its salts. Pectins, starches, mucilage or natural gums are further examples of film-forming binders which may be used.

If desired the film-forming binder may be used in such proportion as to constitute substantially the whole of the combustible matter or fuel in the smoking material. Preferably however, a nonbinding fuel, especially a particulate fuel is also used, the main function of the binder then being to cause all the ingredients to adhere sufficiently well for fabrication of the material.

Particulate fuels which may be used include tobacco powder; carbohydrates - particularly cellulose; and especially modified carbohydrates, by which we mean carbohydrates which have been subjected to a treatment producing modification of a chemical nature.

Desirably the modified carbohydrate which may be used is a thermally degraded carbohydrate, especially thermally degraded cellulose, prepared for example as described and claimed in our United Kingdom Pat. No. 1,113,979 by subjecting carbohydrate to a catalysed degradation process at a temperature of 100°-250° C. until the weight of degraded material is less than 90% of the dry weight of the original carbohydrate.

The modified carbohydrate which may be used may also be a solid condensate prepared by acid or base catalysed condensation of a compound of the formula:

$$R^1CO\ CH_2.CH_2\ COR^2$$

(or a precursor thereof) wherein $R^1$ and $R^2$, which may be the same or different, each represents a hydrogen atom, or an alkyl, hydroxyalkyl or formyl group. Such condensates in fabricated form are described and claimed in our United Kingdom Pat. No. 1,298,354.

A further example of a modified carbohydrate which may be used is oxidised cellulose made for example as described by Kenyon et al ("Industrial and Engineering Chemistry", Volume 41, page 2 et seq.)

Smoking materials of the invention containing high proportions, e.g. from 40 to 65% by weight of inorganic filler are of especial value. Such high proportions have a beneficial effect in reducing the amount of harmful smoke ingredients reaching the smoker. By appropriate choice of the inorganic compounds used, acceptable combustion rates may be imparted to smoking mixtures containing from 40 to 65% of filler, as is described in our British Pat. No. 1,299,296. In particular the anions in the filler may be citrate, formate, oxalate, tartrate, silicate, carbonate, oxide, chloride, sulphate, phosphate or borate. The cations may, in particular, be sodium, potassium, calcium, magnesium, iron or titanium. Preferred fillers are magnesium carbonate, basic magnesium carbonate, calcium sulphate, calcium borate, sodium borate, sodium chloride, calcium orthophosphate, calcium oxalate, iron sulphate, titanium dioxide, alumina, and especially calcium carbonate.

The following are typical proportions by weight of the main ingredients of the smoking materials of the invention

| | |
|---|---|
| Film forming | 10-50% |
| Particulate fuel | 0-30% |

-continued

| | |
|---|---|
| Inorganic filler | 40–65% |
| Smectite | 3–10%, especially 3–7% |
| Other ingredients (humectants, flavourants, etc) | 0–20% |

The invention is not however limited to such proportions.

Smoking mixtures made according to the process of the invention are advantageous compared with corresponding mixtures in which smectite is incorporated in known manner, without being finely dispersed.

In particular cigarettes containing the smoking materials of the invention produce a more coherent ash than cigarettes containing the said corresponding mixtures. This is a discovery of considerable importance in the development of acceptable tobacco substitutes, for the use of high filler proportions, although beneficial on health grounds, leads to the production of flaky non-coherent ash which is noticeably different from tobacco ash. This ash deficiency is noticeable to the smoker even when the tobacco substitutes are blended with high proportions of tobacco.

A further advantage of the smoking materials of the invention lies in the increased combustion retardant properties of bentonite when incorporated in dispersed form. it is therefore possible to avoid or minimise the presence of other combustion retardants, many of which have undesirable effects upon the smoke. In particular magnesium carbonate, a known retardant, gives rise to carbon monoxide.

When an inorganic carbonate particularly calcium or magnesium carbonate is a constituent of the inorganic filler it is especially desirable for its surface area in the dry state to be not greater than 0.6 sq.m/g and more particularly from 0.2 to 0.3 sq.m/g. In this way the proportion of combustion retardants other than the bentonite itself can still further minimised.

An especially preferred smoking material of the invention, has the following final composition:

| | % |
|---|---|
| Film-forming binder | 10 to 20 |
| Particulate fuel, especially thermally degraded cellulose | 20 to 30 |
| Calcium carbonate of surface area 0.05 to 0.6 sq.m/g, more particularly 0.2 to 0.3 sq.m/g | 40 to 50 |
| Dispersed sodium bentonite | 3 to 7 |
| Humectant and any other ingredients | 0 to 10 |

A further feature of the invention provides a process for the manufacture of a smoking material from ingredients comprising a filler-forming binder, an inorganic filler and a smectite which process comprises mixing said ingredients with water, supplying sufficient energy during the mixing operation to cause dispersion of the smectite in the resultant aqueous slurry and fabricating the resultant slurry into a form from which tobacco-simulating material is obtainable.

In a first embodiment the process of the invention comprises agitating the smectite in water with such energy input that the viscosity of the slurry is not less than that of a slurry produced by agitating the same smectite and water at 15° C. with an input of 0.04, preferably 0.08, joules/g/sec until a maximum viscosity is reached, combining the slurry with the remaining ingredients and fabricating the resultant slurry into a form from which tobacco simulating material is obtainable.

In this embodiment of the process the smectite is separately dispersed in water by agitation, preferably under a sufficiently high energy input to increase the viscosity of the slurry up to the value already indicated. Conveniently the other ingredients of the smoking mixture may be slurried together in conventional manner and combined with the dispersed smectite. After sufficient mixing to produce homogeneity the slurry is then fabricated for example into a filament, tape or sheet. Preferably it is cast into a thin film and dried to form a sheet. Alternatively a thick slurry may be extruded to form a filament, tape or sheet. As a further alternative a paper making process may be adopted. The sheet, filament or tape may then be shredded, or cut, into a tobacco-simulating form.

Smoking materials made according to the above embodiment of the process have a more coherent and less porous structure than corresponding materials in which the smectite is incorporated, by known techniques. Accordingly films of such materials are characterised by lower air porosity, a parameter which is measurable as described later, in the introduction to the Examples.

Desirably the air porosity (measured as described later) of a film of smoking material according to the invention 0.05 to 0.2 mm thick should be less than 1000 ml/min, preferably less than 500 ml/min.

In a second embodiment the process of the invention comprises agitating the smectite together with other ingredients of the smoking material at a temperature above 50° C. whereby to disperse the smectite on the slurry, and fabricating the resultant slurry into a tobacco simulating form.

Smoking materials made according to the second embodiment of the process exhibit porosities which, though lower than those of corresponding materials made by known techniques, are generally higher than those of corresponding materials made by the first embodiment. Nevertheless they are advantageous, like the materials made according to the first embodiment, in that they produce a more coherent ash than the known materials, and in that the combustion retardant effect of bentonite, when incorporated in this way, is increased.

The invention is illustrated but not limited by the following Examples in which all parts and percentages are by weight.

The commercially available smectites used in the Examples were as follows:

Berkonite - essentially a calcium bentonite, though a sodium carbonate treatment is involved in its production from naturally occurring material.

Aquagel - a naturally occurring sodium bentonite from USA.

Fulbent 570 - a sodium bentonite prepared by sodium carbonate treatment of a natural calcium bentonite.

Berkbent CE - a sodium bentonite prepared by sodium carbonate treatment of a natural calcium bentonite.

Laponite - (Registered Trade Mark) a synthetic hectorite product.

Throughout the Examples shredded smoking mixtures, or blends in 50/50 proportion with tobacco shred, were used as filling for 1.1 g cigarettes 70 mm long and 25 mm in circumference. The cigarettes were smoked on a standard smoking machine taking 35 ml puffs of 2 seconds duration every minute. Puff numberes were estimated, smoking each cigarette down to a butt length of 20 mm.

Ash cohesion was estimated by weighing on a microbalance the ash cylinder first falling from the cigarette on smoking in a draught free and vibration-free enclosure. The total ash obtained by smoking the complete cigarette was also weighed, and the average ratio of the weight of the first-falling cylinder to the total ash is referred to as the bulk ash cohesion value.

Air porosities were measured on a Bendtsen Mark VI porosity tester, an instrument by which the observed air-flow through a film can be measured at fixed pressure. Air porosity figures quoted were measured at an air pressure of 75 mm of water using a 5 $cm^2$ measuring head, and are expressed in ml/min.

The thermally degraded cellulose used in several Examples was obtained by impregnating cellulose with 7% ammonium sulphamate solution, compressing so that the cellulose retained its own weight of the solution, drying at 165° C. and then heating at 265° C. until a loss in weight of 25-30% occurred.

EXAMPLES 1-3

Dispersion of the bentonites indicated in Table I was carried out by agitating 5 parts in 95 parts of water in a recirculating mill (a PUC mill at setting 3) at 45°-50° C. until constant viscosity was achieved.

Smoking materials were made by forming the following ingredients into an aqueous slurry, incorporating the bentonites dispersed as in the previous paragraph casting the slurry on to a band drier to give a film with a dry basis weight of 48-52 g/sq.m and drying and shredding the film so obtained. This material was blended in 50:50 proportion with tobacco shred.

| | Parts |
|---|---|
| Thermally degraded cellulose | 26.9 |
| Glycerol | 6.0 |
| Calcium carbonate | 45.1 |
| Ammonium sulphate | 2.0 |
| Sodium carboxymethyl cellulose | 15.0 |
| Bentonite | 5.0 |

Cigarette tests on the blends, and on comparative blends made by incorporating dry bentonite in the slurries are indicated in Table I, which also includes determinations of air porosity on the films.

Table I

| Example | Bentonite | State of Addition to slurry | Bulk Ash Cohesion | Puff Number | Air Porosity ml/min |
|---|---|---|---|---|---|
| | None | — | 28 | 9.8 | 700 |
| 1 | Berkonite | Dry | 28 | 9.7 | 1800 |
| | " | Dispersed | 44 | 10.5 | 310 |
| 2 | Aquagel | Dry | 41 | 10.2 | 2150 |
| | " | Dispersed | 54 | 10.4 | 35 |
| 3 | Fulbent 570 | Dry | 40 | 9.9 | 2550 |
| | " | Dispersed | 58 | 10.9 | 200 |

EXAMPLES 4 & 5

Dispersion of the bentonites indicated in Table II was carried out by agitating 5 parts in 95 parts of water at 45°-50° C. with a low shear turbine impeller (power input 0.007 joules/g/sec. until a maximum viscosity had been achieved.

Smoking mixtures were made by forming the following ingredients into an aqueous slurry, incorporating the bentonites dispersed as in the previous paragraph, casting the slurry on to a band drier to give a film with a dry basis weight of 48-52 g/sq.m and drying and shredding the film so obtained.

This material was blended in 50:50 proportion with tobacco shred.

| | Parts |
|---|---|
| Thermally degraded cellulose | 26.9 |
| Glycerol | 6.0 |
| Calcium carbonate (marble) | 47.1 |
| Sodium carboxymethyl cellulose | 15.0 |
| Bentonite | 5.0 |

Cigarette tests on the blends, and air porosity determinations on the films are indicated in Table II.

Table II

| Example | Bentonite (dispersed) | Bulk Ash cohesion | Puff No. | Air Porosity ml/min |
|---|---|---|---|---|
| 4 | Fulbent 570 | 61.2 | 10.2 | 850 |
| 5 | Aquagel | 67.2 | 9.9 | 75 |

EXAMPLES 6-10

In these Examples the bentonites indicated in Table 3 were dispersed in slurries of the other smoking mixture ingredients by stirring at 55°-65° C. The slurries were cast on to a band drier to give a film with a dry basis weight of 48-52 g/sq.cm and the film dried and shredded.

The composition of these films was:

| | Parts |
|---|---|
| Thermally degraded cellulose | 27 |
| Glycerol | 6 |
| Calcium carbonate | 17 |
| Magnesium carbonate | 29 |
| Ammonium sulphate | 2 |
| Sodium carboxymethyl cellulose | 15 |
| Bentonite | 4 |

Two series of films were made:

(a) using coarse calcium and magnesium carbonates having an average surface area of 0.25 $m^2/g$ determined by the air permeability method described by P. J. Rigden in Journal of the Society of Chemical Industry 1943 pages 1 to 4.

(b) using ordinarily available finely divided calcium and magnesium carbonates, of average surface areas 0.87 $m^2/g$.

50:50 Blends of the shredded films and tobacco shred were packed into cigarettes and tested as indicated above. The test results are given in Table III.

Table III

| Example | Bentonite | $CaCO_3$ and $MgCO_3$ | Slurry Temp. ° C. | Bulk ash cohesion | Puff No. | Air Porosity ml/min |
|---|---|---|---|---|---|---|
| | None | Coarse | 60 | 23.6 | 10.5 | 2850 |
| 6 | Fulbent | Coarse | 60 | 50.3 | 11.9 | 2550 |
| 7 | Fulbent | Fine | 60 | 41.6 | 11.6 | 2400 |
| 8 | Aquagel | Coarse | 60 | 46.7 | 11.5 | 2340 |
| 9 | Aquagel | Fine | 60 | 38.5 | 10.6 | 1150 |
| 10 | Berkbent CE | Fine | 60 | 37.6 | 11.2 | 2200 |

EXAMPLE 11

A smoking material was made by slurrying the following ingredients in water at 65° C., casting into a film and drying

| | Parts |
|---|---|
| Thermally degraded cellulose | 27 |
| Glycerol | 6 |
| Calcium carbonate | 15.5 |
| Magnesium carbonate | 26.5 |
| Ammonium sulphate | 2 |
| Sodium carboxymethyl cellulose | 15 |
| Berkbent CE | 8 |

For comparison an identically constituted smoking material was made by slurrying at 28° C.

Similarly comparative materials were made without the Berkbent CE, the calcium and magnesium carbonate proportions being adjusted to maintain a constant ratio of calcium to magnesium.

Each shredded film was blended with tobacco in 50:50 proportion and cigarettes packed with the blend were tested as indicated above. Test results were given in Table IV.

Table IV

| Example | Slurry temp. | Puff No. |
|---|---|---|
| 11 | 60° C. | 12.1 |
| Comparative | 28° C. | 11.0 |
| Comparative No Berkonite CE | 60° C. | 11.1 |
| Comparative No Berkonite CE | 28° C. | 10.6 |

EXAMPLE 12

A smoking material was made by slurrying the following ingredients in water at 60° C., casting into a film and drying

| | Parts |
|---|---|
| Sodium carboxymethyl cellulose | 30 |
| Glycerol | 6 |
| Calcium carbonate | 28 |
| Perlite | 28 |
| Berkbent CE | 8 |

For comparison an identically constituted smoking material was made by slurrying at 28° C.

Each shredded film was blended with tobacco in 50:50 proportion and cigarettes packed with the blend were test smoked as indicated above. Test smokings were also made on cigarettes packed with 100% shredded film. Results are given in Table V.

Table V

| Example | Slurry temp. | Puff No. 50:50 blend | Puff 100% |
|---|---|---|---|
| 12 | 60 | 10.2 | Glow-proofed |
| Comparative | 28 | 9.5 | 7.2 |

EXAMPLE 13

A smoking material was made by slurrying the following ingredients in water at 60° C., casting into a film and drying.

| | Parts |
|---|---|
| Thermally degraded cellulose | 27 |
| Sodium carboxymethyl cellulose | 15 |
| Glycerol | 6 |
| Calcium carbonate | 16 |

-continued

| | Parts |
|---|---|
| Perlite (Celite PF1 grade) | 28 |
| Berkbent CE | 8 |

For comparison an identically constituted smoking material was made by slurrying at 28° C.

Each shredded film was blended with tobacco in 50:50 proportion and cigarettes packed with the blend were test smoked as indicated above. Test smokings were also made on cigarettes packed with 100% shredded film. Results are given in Table VI.

Table VI

| Example | Slurry temp. | Puff No. (50:50) blend) | Puff No. (100%) |
|---|---|---|---|
| 13 | 60 | 10.5 | 8.8 |
| Comparative | 28 | 9.3 | 7.6 |

EXAMPLE 14

A smoking material was made by slurrying the following ingredients in water at 60° C., casting into a film and drying.

| | Parts |
|---|---|
| Thermally degraded cellulose | 27 |
| Glycerol | 6 |
| Calcium Sulphate | 42 |
| Ammonium Sulphate | 2 |
| Sodium carboxymethyl cellulose | 15 |
| Berkbent CE | 8 |

For comparison an identically constituted smoking mixture was made by slurrying at 28° C.

Each shredded film was blended with tobacco in 50:50 proportion and cigarettes packed with the blend were test smoked as indicated above. Results are given in Table VII.

TABLE VII

| Example | Slurry temp. | Puff Number |
|---|---|---|
| 14 | 60 | 14.2 |
| Comparative | 28 | 13.7 |

EXAMPLE 15

An aqueous dispersion was made by vigorously agitating 3 parts of Laponite in 97 parts of water at 45°-50° C. until constant viscosity was achieved.

A smoking material was made by forming the following ingredients into an aqueous slurry, incorporating the Laponite as a dispersion and casting the slurry onto a band dryer to give a film.

For comparison an identically constituted smoking mixture was made, introducing the Laponite as a dry powder into the slurry.

Each shredded film was blended with tobacco in 50:50 proportion and cigarettes packed with the blend were test smoked as indicated above. Test smokings were also made on cigarettes packed with 100% shredded film. Results are given in Table VIII

TABLE VIII

| Example | Puff Number (50:50 blend) | Puff Number (100%) |
|---|---|---|
| 15 | 11.9 | 12.4 |

TABLE VIII-continued

| Example | Puff Number (50:50 blend) | Puff Number (100%) |
|---|---|---|
| Comparative | 11.5 | 9.5 |

We claim:

1. A process for the manufacture of a smoking material from ingredients comprising a combustible film forming binder, inorganic filler and a smectite which process comprises dispersing the smectite separately in water by agitation to produce a slurry having a viscosity not less than that of a slurry made from the same smectite and water by agitation at 15° C. with an energy input of 0.04 joules/g/sec until a maximum viscosity is reached, thereafter mixing the slurry with the remaining ingredients and fabricating the resultant slurry mixture into a form from which a tobacco-simulating material is obtainable.

2. A process according to claim 1 wherein the viscosity of the smectite slurry is not less than that of a slurry made from the same smectite and water by agitation at 15° C. with an input of 0.08 joules/g/sec until a maximum viscosity is reached.

3. A process according to claim 1 wherein the smectite is a bentonite.

4. A process according to claim 1 wherein the combustible film-forming binder is the only combustible ingredient of the smoking material.

5. A process according to claim 1 wherein the ingredients further comprise a non-binding fuel.

6. A process according to claim 1 wherein the ingredients further comprise a particulate fuel.

7. A process according to claim 6 wherein the particulate fuel is a thermally degraded carbohydrate.

8. A process according to claim 6 wherein the particulate fuel is thermally degraded cellulose.

9. A process according to claim 1 wherein the film-forming binder is sodium carboxymethylcellulose.

10. A process according to claim 1 wherein the inorganic filler constitutes 40 to 65% by weight of the ingredient.

11. A process according to claim 1 wherein the ingredients are constituted by 10–50% by weight of film-forming binder, 0–30% by weight of particulate fuel, 40–65% by weight of inorganic filler, 3–10% by weight of smectite and 0–10% by weight of humectants and flavourants.

12. A process according to claim 1 wherein the smectite constitutes 3–7% by weight of the weight of the ingredients.

* * * * *